United States Patent [19]

Gillbrand et al.

[11] Patent Number: 4,665,922

[45] Date of Patent: May 19, 1987

[54] IGNITION SYSTEM

[75] Inventors: Per S. Gillbrand, Enhörna; Sven H. Johansson, Åmål, both of Sweden

[73] Assignee: Saab-Scania Aktiebolag, Sweden

[21] Appl. No.: 913,530

[22] Filed: Sep. 30, 1986

Related U.S. Application Data

[62] Division of Ser. No. 590,580, Mar. 1, 1984, Pat. No. 4,637,368.

[30] Foreign Application Priority Data

Jul. 9, 1982 [SE] Sweden ..... 8204248

[51] Int. Cl.[4] ..... F02P 3/06; F02P 13/00

[52] U.S. Cl. ..... 123/647; 123/143 C; 123/635; 123/643

[58] Field of Search ..... 123/143 C, 169 PA, 169 PB, 123/169 PH, 635, 643, 647

[56] References Cited

U.S. PATENT DOCUMENTS

| | | | |
|---|---|---|---|
| 2,013,381 | 9/1935 | Fedden | 123/143 C |
| 3,902,471 | 9/1975 | Brungsberg | 123/647 X |
| 4,198,943 | 4/1980 | Worz | 123/647 X |
| 4,502,454 | 3/1985 | Hamai et al. | 123/643 X |

FOREIGN PATENT DOCUMENTS

| | | | |
|---|---|---|---|
| 1498942 | 1/1978 | United Kingdom | 123/635 |

*Primary Examiner*—Tony M. Argenbright

*Attorney, Agent, or Firm*—Ostrolenk, Faber, Gerb & Soffen

[57] ABSTRACT

The invention relates to an ignition system for a multi-cylinder Otto-type four-stroke engine equipped with at least one spark plug per cylinder, the ignition system including for each spark plug an ignition device (61,62) connectible to said spark plug in the engine substantially without cables, the ignition system also incorporating a control unit (8) sending signals in response to the engine operating conditions for triggering sparks at the spark plugs in a predetermined order. In order to ensure, in such ignition systems, transmission of maximum ignition voltage to the engine spark plugs and enable simple and safe handling of the ignition system during service and the like, the invention is mainly distinguished in that the ignition devices (61,62) to at least two adjacent spark plugs are included in a common, handleable unit, a so-called ignition cassette (70). To advantage, the ignition system is of the capacitive type including an electric low-voltage block (2) and an electric high-voltage block (1), the high-voltage block (1) being included in one or more ignition cassettes (70).

4 Claims, 3 Drawing Figures

IGNITION SYSTEM

CROSS-REFERENCE TO RELATED APPLICATION

This is a division of application Ser. No. 590,580, filed Mar. 1, 1984, now U.S. Pat. No. 4,637,368.

BACKGROUND OF THE INVENTION

1. Field of the Invention

The present invention relates to an ignition system for a multi-cylinder Otto-type four-stroke engine equipped with at least one spark plug for each cylinder, the ignition system including for each spark plug an ignition device connectible substantially without cables to said spark plug in the engine, the ignition system also including a control unit which sends signals in response to the engine operating conditions for triggering sparks at the spark plugs in a given order.

The invention is preferably applicable in a capacitive ignition system including an electric low-voltage block and an electric high-voltage block.

2. Description of Related Art

Capacitive ignition systems have so far not come to any great use on multi-cylinder four-stroke engines propelling automobiles. The reason for this would appear to be that for such engines the dominating inductive ignition systems have been cheaper and have also been able to meet the majority of technical requirements so far placed on them. Known applications of capacitive ignition systems on multi-cylinder Otto-type four-stroke engines have therefore been limited to automobiles intended for sporty driving i.e. driving to a large extent with high engine load and high engine r.p.m. Under such hard driving, the heat stresses in the combustion chambers of the engine increase, and to avoid so-called knocking during the combustion sequences it is important to use spark plugs with good heat conductivity, so-called cold sparkplugs. However, at low engine load the risk of soot deposits and moisture on the insulators of the cold spark plugs increases, and accordingly there also increases the risk that the spark formation between the electrodes of the spark plugs will fail due to creeping currents across the insulators. In comparison with a conventional inductive ignition system, the capacitive ignition system has spark formation with a very short rise time in the ignition voltage, and this not only enables accurate ignition at high load and high engine r.p.m. but also satisfactory ignition for sooty plugs and at low engine load and r.p.m. occurring during idling.

Capacitive ignition systems used up to now on automobile engines have been of a type where the ignition voltage from the ignition coil, also known as ignition transformer, has been taken via a distributor and high-voltage ignition cables to the respective spark plug. Such a design has certain deficiencies however, since the short rise time to a comparatively high ignition voltage level of the capacitive ignition system causes problems in obtaining satisfactory screening of the high-voltage block of the system to a reasonable cost. For the same reason, the risk of flashover in the distributor and ignition cables also increases and constitutes a limiting factor for the voltage level of the ignition current. Thus, the prospects of producing at high compression pressures a spark which is capable of providing complete ignition of the fuel-air mixture compressed in the cylinder are reduced. The increased risk of flashover furthermore places great demands on carefulness in manual operations on the ignition system, e.g. during service or the like.

In the other types of internal combustion engines, e.g. Otto-type two-stroke engines for power saws or the like, it is known to use capacitive ignition systems with an ignition coil connected to the spark plug and built into a unit directly attachable to the spark plug. A capacitive ignition system of this kind lacks ignition timing regulation and furthermore has deficiencies with regard to radio screening, servicability etc.

The present invention has the object of implementing an ignition system of the kind disclosed in the introduction for a multi-cylinder Otto-type four-stroke engine equipped with at least one spark plug for each cylinder, said ignition system including for each spark plug an ignition device connectible to said spark plug in the engine substantially without cables, the invention mainly being distinguished in that the ignition devices for at least two adjacent spark plugs are included in a common, handleable unit, a so-called ignition cassette.

The invention is further distinguished in that the ignition system is of the capacitive type including an electric low-voltage block and an electric high-voltage block, characterized in that the high-voltage block is included in one or more ignition cassettes. Preferably, the ignition devices to all the spark plugs in the engine are included in a single common unit, which enables safe and expedient handling of the unit, while the absence of high-voltage cables and distributors enables good radio screening.

In the inventive solution there is provided a substantially direct connection of the high-voltage block to the spark plugs, which ensures that high ignition voltage with a short rise time can be transmitted to the spark plugs. This enables the spark plugs to be made with large spark gaps without the risk of the sparks failing to jump. Such a relatively large spark gap facilitates complete combustion of the fuel-air mixture in the cylinder, while in particular the content of hydrocarbons (HC) in the exhaust gases may thus be restricted. In an advantageous embodiment of the invention, the engine is provided with spark plugs having a spark gap exceeding 1.0 mm.

BRIEF DESCRIPTION OF THE DRAWINGS

Other distinguishing features of the invention will be apparent from the following claims and the exemplified embodiment of the invention described below. The description is made with reference to the appended figures, of which FIG. 1 schematically illustrates an inventive capacitive ignition system for automobiles.

DESCRIPTION OF A PREFERRED EMBODIMENT

Figure 1:
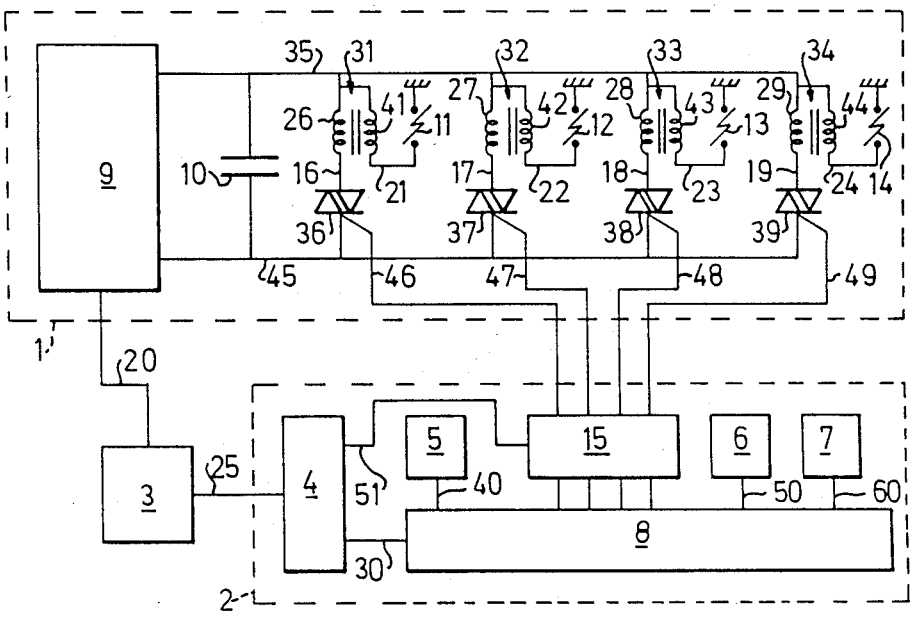

As will be seen from FIG. 1, a capacitive ignition system according to the invention is divided into a high-voltage block 1 and a low-voltage block 2 which are conductively connected to each other and to a current supply unit 3. The automobile battery (not shown) is included in the latter, from which low-voltage current is fed via a connection 25 to a voltage stabilizer 4 included in the low-voltage block 2, and via a connection 20 to a charging unit 9 included in the high-voltage block 1. The low-voltage block 2 includes components substantially operating on low-voltage current up to 12 volts, while the high-voltage block 1 includes components operating with current voltages thereabove Apart from the voltage stabilizer 4, the low-voltage block 2 mainly comprises a number of transducers 5,6,7 arranged on the engine for sensing the engine operating conditions, and a trigger circuit 15 and an electronic control unit 8 in the form of a computer. The transducers 5–7 are conductively connected to the control unit 8, which via a connection 30 obtains current from the voltage stabilizer 4. Also the trigger circuit 15 obtains current from the voltage stabilizer 4, via a connection 51.

The high-voltage block 1 includes, apart from the charging unit 9, an ignition capacitor 10 as well as a discharge circuit 16–19 and an ignition circuit 21–24 for each of the four spark plugs 11–14 of the engine. A voltage converter (not shown) included in the charging unit 9 transforms the low voltage to a charge voltage of between 200 and 600 volts. The capacitor 10 is arranged between two connections 35,45 leaving the charging unit 9, and together with the charging unit 9 forms a charging circuit for storing ignition energy. A voltage regulator (not shown) included in the charging unit 9 interrupts charging of the capacitor 10 at a preselected voltage level.

The capacitor 10 is disposed for coaction with four discharging circuits 16–19 connected in parallel between the connections 35,45. Each discharging circuit 16–19 includes the primary winding 26–29 of an ignition transformer 31–34 and a contactless switch 36–39 connected in series with the primary winding 26–29, this switch being a so-called triac. The secondary winding 41–44 of each ignition transformer 31–34 is connected to a respective spark plug 11–14 in the engine.

Each triac element, i.e. each switch 36–39, consists of a semiconductor element in the form of two opposingly directed thyristors connected in parallel. Such a triac element can be caused to change between an open state allowing current passage and a closed state not allowing current passage in response to an exterior control signal which is applied to the triac element via a so-called trigger connection 46–49, respectively, from the control unit 8 of the low-voltage block. In response to an output signal from the control unit 8 to a trigger connection 46–49, e.g. connection 46, the triac element 36 assumes a closed state. Via the primary winding 26 and the triac element 36, the ignition capacitor 10 is thus discharged from the charging voltage level, e.g. 400 volts on the connection 35, to the supply voltage level, about 12 volts, on the connection 45. In the secondary winding 41 of the ignition transformer 31 there is thus induced an ignition voltage proportional to the winding ratio of the transformer, and this ignition voltage is applied via the ignition circuit 21 to the spark plug 11 for generating a spark between its electrodes.

The control unit 8 distributes output signals to the trigger connections 46–49 in response to conventional input signals controlling the ignition timing and coming from the transducers 5,6,7 on the engine. The transducer 5 senses two marks situated 180° from each other on the engine flywheel (not shown) and sends a signal corresponding thereto to the control unit 8 via a connection 40. This signal is suitably in the form of a squarewave that gives information on the piston positions relative to the top dead center (TDC) as well as information on the engine r.p.m. The transducer 6 senses a mark on the engine cam shaft (not shown) and sends a signal corresponding thereto to the control unit 8 via a connection 50, this signal giving information as to when a given cylinder is in line for ignition. The transducer 7 senses the inlet pressure to the engine and sends a signal corresponding thereto to the control unit 8 via a connection 60.

The trigger connections 46–49 from the control unit 8 to the triac elements 36–39 pass through the trigger circuit 15 included in the low-voltage block 1, where trigger signals from the control unit 8 are filtered and adapted for controlling the triac elements 36–39. With this purpose in mind, the trigger circuit 15 can to advantage contain a so-called opto-coupler which allows disturbance-free and accurate transmission of the trigger signals.

Figure 3:
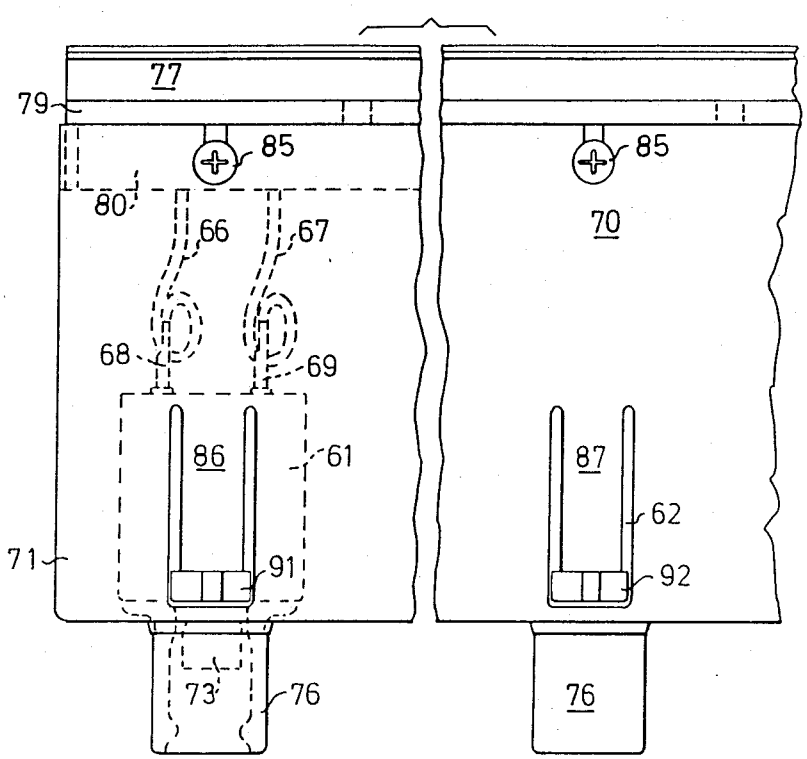
FIG. 3 is a plan view of a portion of the ignition cassette according to FIG. 2.
Figure 2:
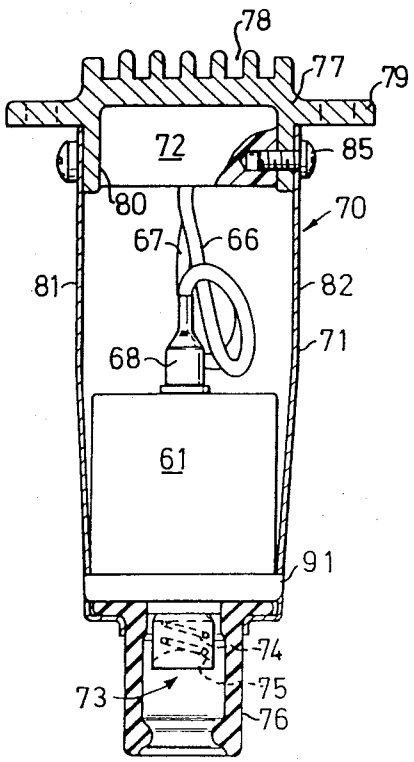
FIG. 2 is a cross section through an ignition cassette comprising the high-voltage block of the ignition system.

In an embodiment illustrated in FIGS. 2 and 3, the high-voltage block depicted FIG. 1 is integrated into a combined unit in the form of a so-called ignition cassette 70. This is outwardly defined by a metal casing 71 including two longitudinal side panels 81,82 and an upper part 72 formed as an intermediate member, preferably of aluminium, there also being provided four rubber boots 76 mounted on the bottom portion of the ignition cassette 70. Four ignition devices 61,62 are included in the ignition cassette 70, one for each spark plug 11–14, these ignition devices 61,62 being connected to each other and to the upper part 72 via the metal casing 71.

Each ignition device 61,62 includes in turn an ignition transformer 31–34. The ignition capacitor 10 and the triac elements 36–39 included in the discharging circuits 16–19 are all included in the upper part 72 formed as an intermediate member, which includes all the electronics included in the high-voltage block 1 of the ignition system, with the exception of the ignition devices 61,62. The top side of the upper part 72 is formed as a metal bar 77 provided with cooling fins 78, this bar 77 extending along the whole of the ignition cassette 70 and enabling dissipation of heat generated in the upper part 72.

The bar 77 is formed with two longitudinal, dependent flanges 80 against which the side panels 81,82 are fixed with the aid of screws 85, the bar 77 furthermore being provided with holed longitudinal side flanges 79 for enabling attachment of the ignition cassette 70 to adjacent engine parts with the aid of screws.

The lower portion of each side panel 81,82 is connected to the respective ignition device 61,62 by tongues 86,87 cut out of the metal casing 71 snapping on to abutments 91,92 formed on the outer sides of the respective ignition device 61,62. Each of the end walls formed by the side panels 81, 82, one of the former being illustrated in FIG. 3, is closed off by a folded-over end of either of the side panels 81,82. The metal casing 71 includes a bottom plate, not illustrated, which is bent up from one of the side panels 81,82 and is formed with a number of cut-outs (not shown) for enabling the ignition devices 61,62 to maintain contact with the spark plugs 11–14.

The ignition capacitor 10 and the triac elements 36–39 in the upper part 72 are connected to the primary windings 26–29 of the ignition transformer 31–34 via cables 66,67 which are provided at their ends with the usual electrical connection means 68,69. The cables 66,67 only carry charging voltages of between 200 and 600 volts and do not need ignition voltage insulation.

The secondary winding 41–44 of each ignition transformer 31–34 is intended to obtain communication with the central electrode (not shown) of a spark plug 11–14 via a conventional connection means 73. Since the ignition cassette 70 is to be rigidly attached to the engine, it is satisfactory to connect the ignition devices 61,62 to the respective spark plug 11–14 by a spring 74 contained in the connection means 73, which ensures that a contact plate 75 is brought into engagement with the central electrode of the spark plug 11–14. The individual connection means 73 are protected by rubber boots 76 included in the cassette 70. When mounted in position at the spark plug 11–14, each rubber boot 76 seals against the insulator of the respective spark plug 11–14. To protect the ignition transformers 31–34 against damage from the outside, each ignition device 61-62 has a so-called "solid state" implementation where the ignition transformer 31–34 is entirely encapsulated in a plastics material.

The electronic circuits in the upper part 72 are also entirely or partially encapsulated in a plastic body according to said "solid state" technique. Said plastic body is in turn molded-in between the longitudinal dependent flanges 80 on the bar 77.

The ignition cassette 70 so obtained enables extremely simple and safe handling of the ignition system high-voltage block 1. The considerable danger connected with careless operations on the ignitions systems of today, in which a great number of high-voltage cables and the separate ignition distributor are obvious sources of risk, has been substantially reduced. The cassette 70 can be rapidly fitted and removed both for service and during original assembly of the engine. The many screening details which a conventional ignition system requires for spark plug, ignition distributors and ignition coil can be entirely replaced in the inventive ignition system by the metal casing 71 surrounding the ignition cassette 70. Screening will thus be both cheaper and more effective.

By connecting the ignition cassette 70 containing the high-voltage block 1 to the spark plugs 11–14 essentially without the use of cables, there is ensured transmission of maximum ignition voltage to the spark plugs 11–14. The lack of long cable connections and compact implementation of the high-voltage block 1 also limits the capacitive load on the ignition system. This results in an extremely high frequency for the ignition voltage with a correspondingly short rise time for it. There is thus enabled the utilization of spark plugs 11–14 with large heat conductivity, so-called cold plugs, since the risk for spark failure, e.g. during cold starting, is substantially reduced in practice due to the short rise time of the ignition voltage.

This means that the advantages accompanying the use of "cold" spark plugs with high engine load and r.p.m. may also be utilized for ordinary driving. The great heat conductivity of the cold spark plugs results in an increased margin against uncontrolled combustion, i.e. knocking, in the engine when it is heavily loaded and/or when alcohol-containing fuel is used. This means that for a given engine, a higher compression ratio may be selected than is otherwise applicable to the engine, resulting in that the engine can more advantageously utilize the supplied energy, i.e. it will have a lower fuel consumption.

Further to this, the short rise time of the ignition voltage together with the electronic ignition distribution in the control unit 8 results in that the ignition timing also at high engine r.p.m. can be controlled exactly for optimum fuel consumption and/or power output.

The short rise time to a high voltage level is followed in the capacitive ignition system by a rapid drop in the ignition voltage. The duration of the spark between the spark plug electrodes will consequently be short, even if the transmitted ignition energy is considerable. The possible contact between the spark and the fuel-air mixture will thus be limited with the risk of incomplete combustion as a consequence. In particular, the content of uncombusted hydrocarbons in the exhaust gases may tend to increase. An increase of the electrode gap in the spark plugs 11–14 increases the spark volume, however, and thereby increases the possibilities for complete ignition of the fuel-air mixture and thereby complete combustion with limited hydrocarbon contaminants in the exhaust gases.

In practical tests carried out with an inventive ignition system on a four-cylinder Otto-type four-stroke engine for a passenger automobile, the electrode gap in the spark plugs used has exceeded 1.0 mm and to advantage has been between 1.1 and 1.5 mm. This gap can be compared with the electrode gap of about 0.7 mm in an inductive ignition system. The contaminant content in the engine exhaust gases in the above-mentioned practical tests has fallen below limiting values set in governmental regulations by a good margin.

In the above description of an embodiment exemplifying the invention, it is stated that there is connected substantially without cables of the ignition devices 61,62 to the respective spark plugs 11,14. However, this does not exclude the possibility of utilizing short cables between the ignition devices 61,62 and the spark plugs 11–14.

It is also possible in an inventive ignition system to provide the control unit 8 with a circuit repeating the trigger signals, this circuit sending two or more trigger signals to the same triac element 36–39 in close sequence from the ignition point for the respective engine cylinder, but even so with sufficient time interval for the ignition capacitor 10 to have time to be charged after the previous discharge. In this way the ignition system can, for example, send two consecutive sparks as long as the engine operates at low working temperature and low r.p.m., e.g. under 2000 r.p.m., and when circumstances otherwise do not ensure the ignition of the fuel-air mixture with only one spark. It should be noted here that during the spark duration time for the spark in a conventional inductive ignition system, i.e. a time of over 1 ms, an inventive capacitive ignition system has time to generate at least three consecutive sparks.

The described embodiment must not be considered to restrict the invention, which can be modified into a plurality of alternative embodiments within the scope of the inventive concept and the following claims.

We claim:

1. An ignition system for a multi-cylinder Otto-type engine having at least one spark plug per cylinder, the ignition system comprising:

(a) a high-voltage block for transferring energy to trigger said spark plugs, the high-voltage block including
  (1) a charging unit;
  (2) at least one ignition capacitor charged by the charge unit;
  (3) a plurality of switching elements for transferring energy from the ignition capacitor; and (4) A plurality of ignition devices for receiving energy from said switching elements and transferring said energy to said spark plugs, each of said ignition devices including an ignition transformer for transforming said energy to generate an ignition voltage for triggering said spark plugs;

(b) a cassette unit in which said high-voltage block is contained, said cassette unit being handleable and including a rigid metal bar, said capacitor, switching elements and charging unit being substantially completely embedded in plastic material and fixed to said rigid metal bar; and (c) a low-voltage block including an electrical control unit for sending signals to control said high-voltage block for triggering said spark plugs.

2. An ignition system as in claim 1, comprising one switching element and one ignition device for each spark plug, each switching element including a triac, and each ignition device including a casing which encapsulates the ignition transformer of said ignition device.

3. An ignition system as in claim 2, in which each ignition transformer has a primary winding and a secondary winding, the primary winding being releasably electrically connected to the ignition capacitor and to one of the switch elements.

4. An ignition system as in claim 3, further comprising a plurality of contact means, each contact means being connectable by a direct, resilient, cableless connection to an input electrode of a corresponding spark plug, the secondary winding of the respective ignition transformer corresponding to said spark plug being connected directly and without cables to said contact means.

* * * * *